United States Patent [19]

Barrett et al.

[11] Patent Number: 5,065,805

[45] Date of Patent: Nov. 19, 1991

[54] DISPLAY ENCLOSURE AND SEGMENTED FLEXIBLE CLOSURE THEREFOR

[75] Inventors: David M. Barrett, Fort Myers, Fla.; Timothy J. Brown, Oklahoma City, Okla.

[73] Assignee: David M. Barett, Ft. Myers, Fla.

[21] Appl. No.: 680,380

[22] Filed: Apr. 4, 1991

[51] Int. Cl.[5] ..... E06B 9/08

[52] U.S. Cl. ..... 160/23.1; 160/133

[58] Field of Search ..... 160/23.1, 133, 193, 160/188, 26; 312/138.1, 196, 139.2; 49/74

[56] References Cited

U.S. PATENT DOCUMENTS

| | | | |
|---|---|---|---|
| 1,352,656 | 9/1920 | Cahill | 160/219 |
| 2,390,116 | 12/1945 | Michelman | 169/219 X |
| 3,160,200 | 12/1964 | McKee et al. | 160/193 X |
| 4,365,660 | 12/1982 | Henkenjohann | 160/133 |
| 4,899,491 | 2/1990 | Okumoto | 160/236 X |
| 4,995,440 | 2/1991 | Vorsmann | 160/133 X |

*Primary Examiner*—Blair M. Johnson

*Attorney, Agent, or Firm*—Laney, Dougherty, Hessin & Beavers

[57] ABSTRACT

A cabinet includes a rigid housing having an opening at the forward side thereof with vertical guide tracks defined at opposite sides of the opening. A roller subassembly is mounted in the upper portion of the housing over the opening and is driven in rotation about a horizontal axis by a motor. A segmented glass curtain made up of contiguous, elongated, parallel glass slats of rectangular configuration closes the opening in the housing. Each glass slat is supported in metal corner brackets interconnected so that adjacent longitudinal edges of adjacent slats are in close proximity, and the slat ends project into the guide tracks. Flexible cables interconnect the corner brackets to maintain the spacial relationship of the slats. Ends of the cables are connected to the roller subassembly and the curtain is rolled up on the roller subassembly to open the opening in the housing.

9 Claims, 3 Drawing Sheets

DISPLAY ENCLOSURE AND SEGMENTED FLEXIBLE CLOSURE THEREFOR

FIELD OF THE INVENTION

This invention relates to a transparent, segmented, slatted curtain which is flexible, and which can be rolled out to cover an opening, or which can be rolled up on a roller in a way which does not fracture or break the glass slats of the curtain.

BACKGROUND OF THE INVENTION

Brief Description Of The Prior Art

It has been difficult to provide an aesthetic, fully transparent, flexible, segmented curtain which functions as a closure for closing the opening into an enclosure, but which can be quickly and easily rolled up into an out-of-the-way, out-of-view location without damaging the glass panels of which the segmented curtain is constructed, and without scarring or gouging the cabinet or other enclosure in which the curtain is mounted. A number of structures have been used which include sight glasses mounted in rigid protective panels which themselves form the slats in a segmented flexible curtain used to close an opening into an enclosure. It is believed, however, that a structure in which contiguous frangible and transparent slats are spaced in close relationship when they are in a monoplanar aperture-closing position, but which can be easily rolled up into a superimposed position on a roller has not yet been successfully constructed.

U.S. Pat. No. 2,390,116 discloses a rolling door construction in which a flexible curtain is formed from a series of transversely extending sections which are hingedly interconnected for relative movement, and are adapted to be wound upon a rotatable drum suitably located at the head of a doorway. The drum has flats on its periphery to accommodate the several transverse sections of the curtain. The flexible curtain incorporates windows suitably arranged therein to permit viewing the interior of the building in which the rolling door or curtain is located.

U.S. Pat. No. 1,352,656 to Cahill provides a similar teaching of a flexible curtain made up of a series of transversely extending flat slat units which are interconnected so that the curtain can be readily rolled up on a roller. Each of the slat units of which the curtain is constructed is adapted to carry a glass panel so as to admit light through the curtain.

A folding flexible segmented closure element is manufactured by a company called SIMU. These closures comprise a plurality of contiguous slats attached to a roller. Shutters and closures provided by this company are made either of metal such as aluminum or steel, or of wood or plastic.

U.S. Pat. No. 3,970,134 describes a rolling shutter assembly which includes parallel shutter slats, and additional locking slats disposed adjacent a shutter storing roller, and serving to connect the roller slats to the roller. Locking slat guide means are provided to prevent an external force applied to the shutter slats from bunching up or disarranging the locking slats. At opposite ends, the shutter slats are guided by a pair of guide rails as they move upwardly and downwardly for the purpose of closing an opening. A drum which is of octagonal cross-section is used to roll up the rolling shutter.

BRIEF DESCRIPTION OF THE PRESENT INVENTION

The present invention provides a flexible transparent curtain which can be positioned in a monoplanar configuration for purposes of closing an opening through an enclosure, but which can also be rolled up so that the curtain is compactly stored in an out-of-the-way position when it is not used to close the opening.

More specifically, the flexible curtain is made up of a plurality of contiguous, flexibly interconnected glass slats which are joined by flexible cables or wires at opposite ends of the slats. These wires function to hold the slats in contiguous, closely spaced relation when the slats are in a monoplanar configuration, but nevertheless permit the slats to be wound upon a cylindrical roller in such a way that the slats tend to lie flat, one on top of the other, and in such way that the risk of breakage of the slats when rolled into the retracted stored status is minimized.

An important object of the present invention is to provide a flexible segmented closure member made up of a plurality of contiguous transparent glass slats which can be stored in a rolled up form on a roller, and at a desired time, rolled from such roller into a monoplanar curtain useful for closing an opening.

Another object of the invention is to provide a glass curtain which can be rolled up in compact form without breakage of the glass.

Another object of the invention is to provide a cabinet or other enclosure which has an opening through which the contents of the cabinet can be viewed, and which carries a rollable curtain made of transparent glass slats which can roll out into a monoplanar form in which the slats are contiguous and collectively extend across the opening.

Yet a further object of the invention is to provide a flexible curtain made up of a plurality of contiguous, interconnected transparent glass panels which can be rolled up into a compact space, which curtain is characterized in having a long and trouble free operating life.

Other objects and advantages of the invention will become apparent as the following detailed description of the invention is read in conjuntion with the accompanying drawings which illustrate a preferred embodiment of the invention.

GENERAL DESCRIPTION OF THE DRAWINGS

FIG. 8 is an elevational view of a structural detail which shows how each flexible segmented curtain is attached at its upper end to a roller subassembly.

DETAILED DESCRIPTION OF A PREFERRED EMBODIMENT OF THE INVENTION

Figure 1:
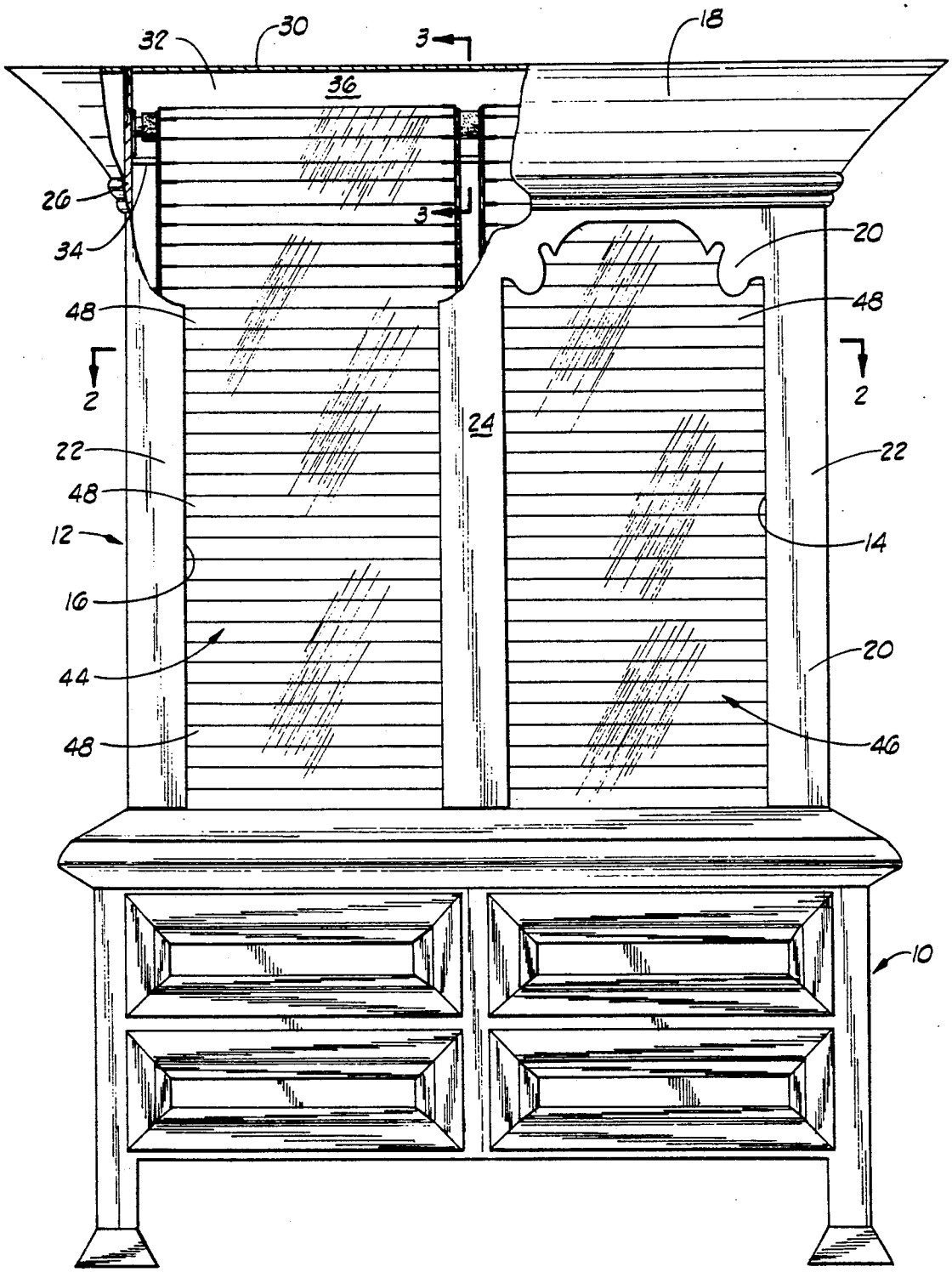
FIG. 1 is a front elevation view of a china cabinet having the present invention incorporated therein, and showing a portion of the china cabinet broken away to better illustrate certain parts of the present invention.

Referring initially to FIG. 1 of the drawings, a china cabinet which incorporates the present invention is there illustrated. In a general application and use, the invention is employed in combination with an enclosure in which articles are retained for storage or display, and are accessed through an opening in the enclosure. The opening in the container or enclosure is closed and opened by a segmented glass curtain which is rolled up and down upon an elongated, horizontally extending roller which is driven in rotation about a horizontal axis by a suitable motor.

In FIG. 1, the china closet illustrated has a base section 10 and an upper, china or dish-containing section 12. The china cabinet here illustrated has a front side which defines a pair of vertically extending openings 14 and 16. At the top of the china cabinet, a facade or soffit 18 is provided. The opening 14 and the opening 16 at the front of the china cabinet are substantially equally sized and shaped, with each having an ornamental, scrolled panel 20 at the upper side thereof. Each opening is defined by a vertically extending outer track panel subassembly 22 at the outer side, and by a centered divider between the two openings 14 and 16 constituted by a central, vertically extending central track panel subassembly 24.

Figure 2:
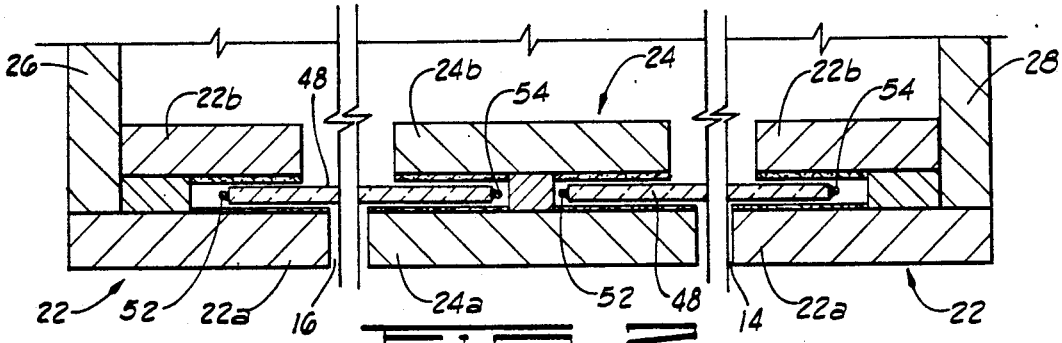
FIG. 2 is a sectional view taken along line 2—2 of FIG. 1.
Figure 3:
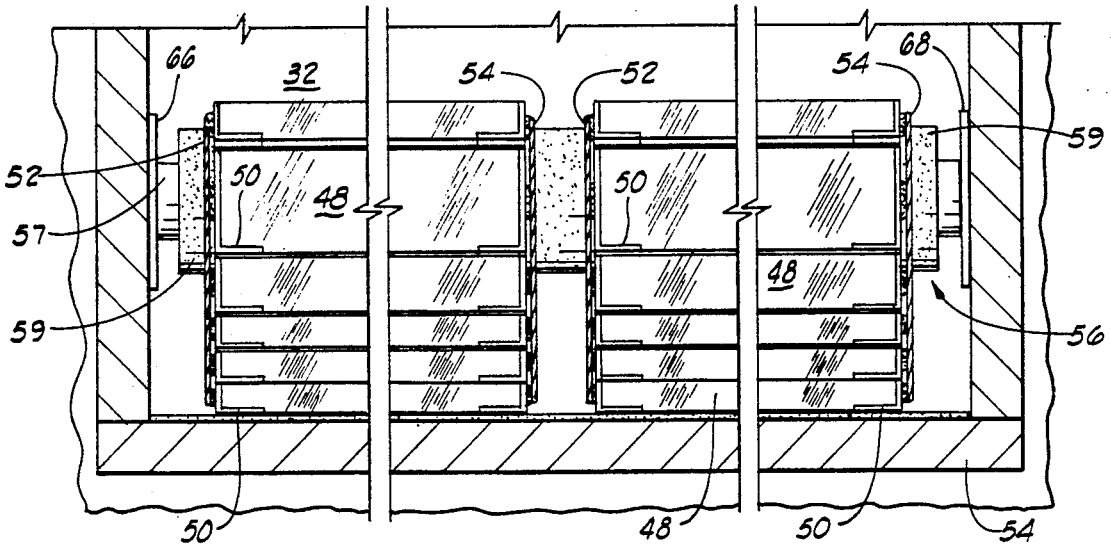
Figure 5:
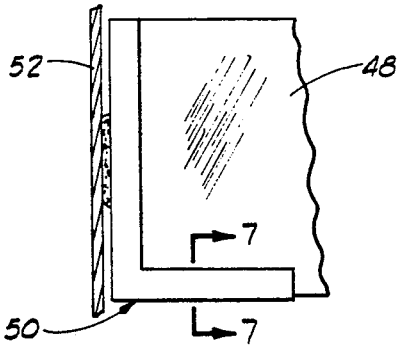
FIG. 5 is an elevation view of the roller employed for raising and lowering the segmented glass curtain and showing the glass slats of the curtain sections as they appear when partially rolled up on the roller.

At its opposite sides, the china cabinet has a pair of opposed, vertically extending, substantially parallel side panels 26 and 28 (see FIG. 2). A horizontally extending top plate or panel 30 extends across the top of the china cabinet and forms a closure for the interior of the cabinet. The top panel 30 extends between the side panels 26 and 28, and acts as an upper closure for a roller chamber 32 located in the upper part of the china cabinet. This construction is perhaps best illustrated in FIGS. 1, 3 and 5 of the drawings. The lower side of the roller chamber 32 is defined by a horizontally extending, rectangular panel 34 which extends parallel to the top panel 30 and is spaced downwardly therefrom within the china cabinet.

The enclosure within the china cabinet is completed by a vertically extending back panel 36 which extends between the rear edges of the side panels 26 and 28, and parallel to the two openings 14 and 16 at the front of the china cabinet. Flexible, segmented curtains close these openings, as shown in FIG. 1, and are hereinafter described in greater detail. Upwardly extending outer track panel subassemblies 22 and the vertically extending central track panel assembly 24 are each configured so that each provides a vertically extending trackway or channel as shown in FIG. 2. The opposite side edges of the two segmented curtains used for closing the openings 14 and 16 move in these trackways during the reciprocating upward and downward motion which these segmented glass curtains undergo during operation of the system.

Thus, in FIG. 2, it will be noted that the upwardly extending outer track panel subassembly 22 located at the left of the china cabinet (as it is viewed in FIG. 1) includes a pair of spaced strips or plates, the forward or outer of which is designated by reference numeral 22*a* and the inner of which is designated by reference numeral 22*b*. The channel or trackway formed by the plates 22*a* and 22*b* opens toward the opening 16, and thus is opened to receive the lateral vertical edge of a first flexible segmented curtain, designated generally by reference numeral 44. At the opposite side of the segmented curtain 40, its vertical side edge is slidingly received by a pair of vertically extending plates or strips 24*a* and 24*b* which make up the vertically extending central track panel assembly 24. The projection of the side edge of the segmented curtain 44 into the trackway formed by the spaced vertically extending strips 24*a* and 24*b* is illustrated in FIG. 2. In similar fashion, the second of the two flexible, segmented curtains, denominated by reference numeral 46, has its opposed vertically extending side edges disposed in the trackway formed by the vertically extending spaced plates 24*a* and 24*b* of the vertically extending central track panel subassembly 24, and also by the vertically extending spaced plates 22*a* and 22*b* located on the right side of the opening 14, and together forming the upwardly extending outer track panel subassembly 22 provided at that location.

An important structural subcombination of the present invention is the flexible, segmented curtain, two of which are provided in the embodiment of the china cabinet here illustrated. The two segmented glass curtains are denominated generally by reference numerals 44 and 46 and are illustrated in the drawings. It will be perceived in referring to FIG. 1 that each segmented curtain 44 and 46 is made up a series of elongated rectangular glass slats which have been denominated by reference numeral 48. Each of the glass slats 48 is of a length sufficient that its opposite end portions extend into the guide channels which are provided by the upwardly extending outer track panel subassemblies 22, along with the cooperating vertically extending central track panel subassembly 24. The glass slats 48 each extend horizontally, and collectively they extend parallel to each other and are in closely contiguous relation with respect to each other. It is important that adjacent edges of adjacent glass slats 48 be very close to each other in order for the segmented glass curtain to perform effectively when opening and closing the openings 14 and 16 in the manner hereinafter described.

Figure 3:
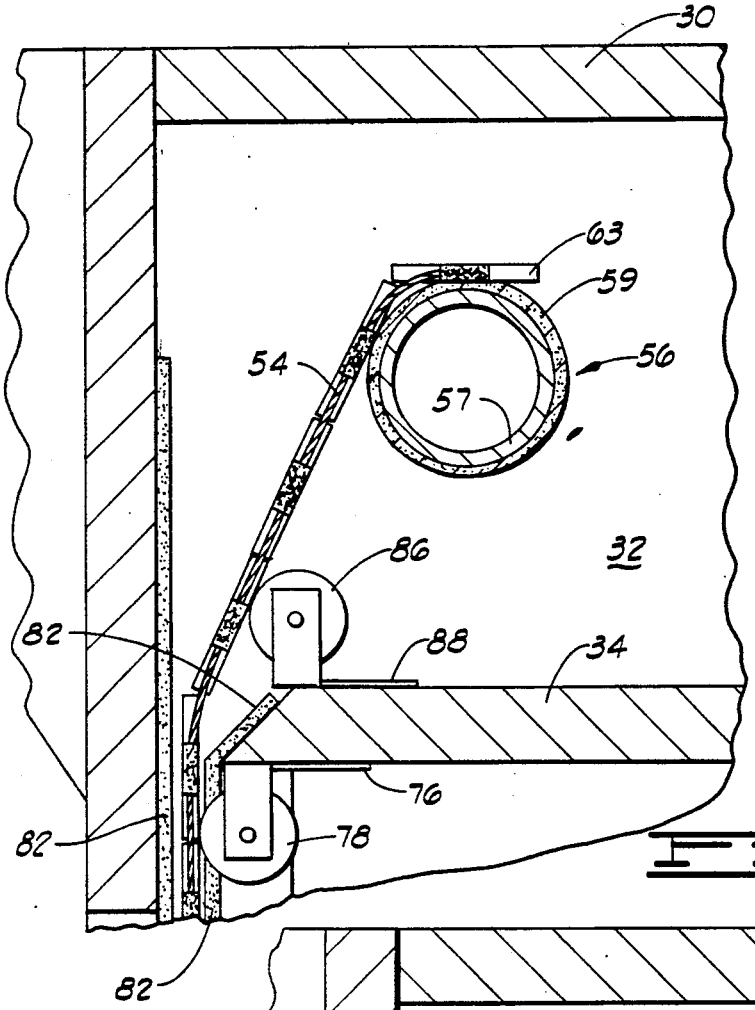
FIG. 3 is a sectional view taken along line 3—3 of FIG. 1.

It will be perceived, when considering the showing of the curtains hereinbefore described, as they are depicted in FIGS. 2 and 3, that the segmented glass curtains 44 and 46 form transparent, substantially dustproof closures for the cabinet, which allow valuable china, crystal or the like which may be located in the cabinet to be viewed.

Figure 7:
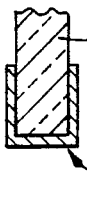
FIG. 7 is a sectional view taken along line 7—7 of FIG. 6.
Figure 6:
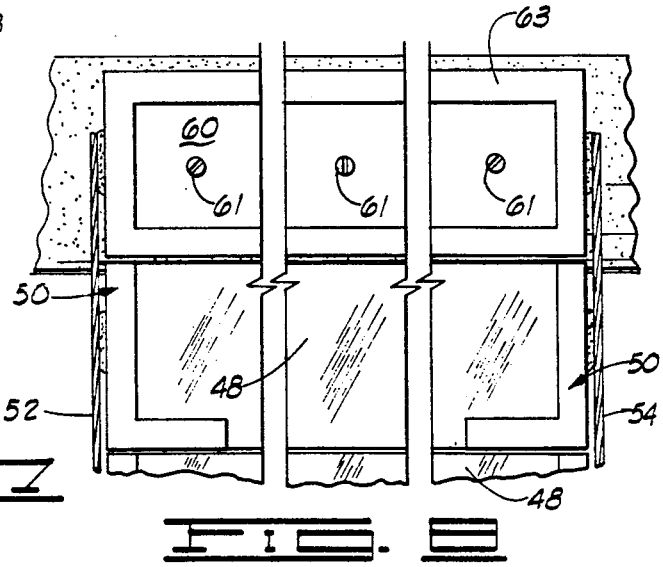
FIG. 6 is a detail view of a corner of one of the glass slats used in the segmented glass curtain forming a part of the invention.

Each one of the segmented glass curtains 44 and 46 is made up of a number of contiguous parallel, interconnected glass slats 48. Each of the slats 48 is substantially identical, and the described spacial arrangement of the slats in the respective segmented curtains is assured by the manner in which each of the slats is mounted, and the several slats are interconnected. Each end of each of each elongated glass slat 48 is received within a metal L-shaped corner bracket 50 which is channel-shaped in cross-sectional configuration. One of the L-shaped corner brackets 50 is depicted in FIG. 6 of the drawings, and its cross-sectional configuration is shown in FIG. 7. The width across the channel formed by each corner bracket 50 is such that the glass panel, the corner of which is placed in this bracket, fits snugly into the bracket and is frictionally retained therein. As indicated by this description, one of the L-shaped corner brackets 50 is provided at each of the opposite ends of each of the elongated rectangular glass slats 48, and this can be perceived as reference is made to FIG. 5 of the drawings.

Each of the corner brackets 50 has one relatively longer leg which receives the end edge of the respective glass slat 48. This leg is substantially the same length as the width of the glass slat received therein. In a preferred embodiment of the invention, each of the glass slats is preferably from about one inch to about $1\frac{3}{4}$ inch in width (i.e. the length of the relatively longer leg of the bracket), and has a thickness of from about $\frac{1}{4}$ inch to about $\frac{3}{8}$ inch.

As previously indicated, each of the glass slats 48, when the respective segmented curtains 44 and 46 are extended into a monoplanar configuration—that is, when the respective curtain is in its closing position—is spaced closely with respect to the adjacent glass slat so that a spacing of from about 1/16 inch to about $\frac{1}{4}$ inch separates contiguous slats.

Figure 4:
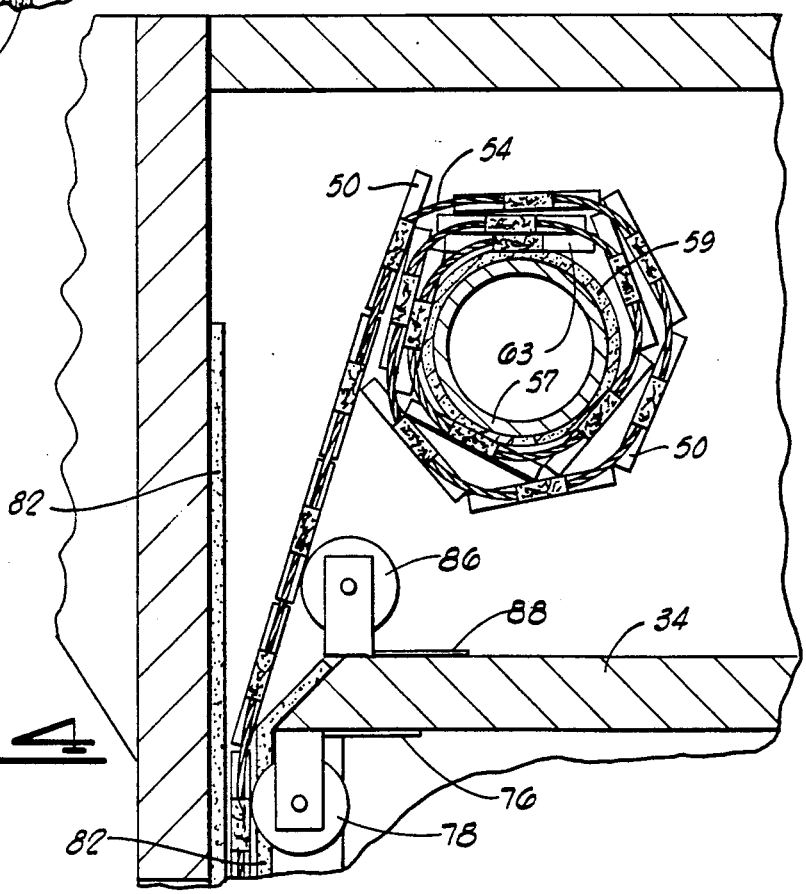
FIG. 4 is a sectional view illustrating certain parts of the invention, including the segmented glass curtain, as it appears when it is rolled up on the drum or roller which is used for raising and lowering the segmented curtain.

Each segmented curtain further includes a pair of elongated, flexible stranded cables or wires 52 and 54. Each stranded cable or wire, 52 or 54, is secured by soldering or other suitable means to each corner bracket at approximately the center of the corner bracket leg, as is best illustrated in FIG. 6. The pair of cables 52 and 54 retains each of the glass slats in the close spacial relationship to adjacent glass slats which has been described, and yet allows the segmented curtain to be adequately flexible so that it can be rolled up when it is to be retracted in order to open the china cabinet. At the time that each of the segmented curtains 44 and 46 is rolled up, as hereinafter described, each cable or wire 52 and 54 is kept taut, but is able to extend directly between adjacent corner brackets 50 with little bending, and thus accommodate the glass slats 48 to an angular juxtaposition on the roller as illustrated in FIG. 4.

In order to facilitate the rolling up or retraction of each of the segmented glass curtains 44 and 46 made up of the contiguous glass slats 48, an elongated roller subassembly 56 is provided. With a double curtain arrangement of the type shown in this embodiment of the invention, the roller subassembly 56 is made up of a pair of end sections which extend from a location relatively near to the center of the roller subassembly to the respective opposite ends of the roller subassembly. The roller subassembly 56 includes a hollow metallic or other rigid cylindrical roller or core 57 which is covered with a relatively thick pad of felt 59. Secured to the outer periphery of the roller at two spaced locations therealong, corresponding to the two end sections described, are a pair of flat aluminum plates 60, each of which is of very slightly greater width and slightly greater length than each of the glass slats 48. One of these is illustrated in FIG. 8. Each aluminum plate 60 is secured substantially tangentially to the periphery of the roller by a plurality of fastening elements 61 as shown in FIG. 8.

The aluminum plates 60 are spaced from each other by a space at the center of the roller, and function to accommodate and support the two segmented curtains 44 and 46 at a time when these are rolled up on the roller. The aluminum plates 60 function as anchor points for the upper ends of the flexible cables or wires 52 and 54, as best illustrated in FIGS. 3 and 8. The upper end of each of the cables or wires 52 and 54 is secured to a metal peripheral rectangular bracket 63 which surrounds and receives the peripheral edge of each one of the flat aluminum plates 60 (see FIG. 8). Each of the brackets 63 has a channel-shaped cross-sectional configuration very similar to each of the brackets 50. It will be noted that the end of each of the flexible cables or wires 52 or 54 is secured at about the middle of the short side of the rectangular bracket 63 which surrounds each of the aluminum plates 60 (see FIGS. 3 and 8).

A supporting shaft (not shown) extends down the center of the roller over its entire length, and is suitably journaled at its opposite ends in journals 66 and 68 provided inside the side walls 26 and 28 of the china cabinet. A suitable motor (not shown) is provided with a gearing system connected to the shaft for the purpose of driving the shaft and the roller carried thereon in rotation. Alternatively, the drive motor may itself project into the cylindrical roller or core and drivingly engage the inner wall thereof.

The way in which the segmented glass curtains 44 and 46 are retracted and extended by rolling them upon, or off of, the roller subassembly located in the roller chamber 32 at the top of the china cabinet is best illustrated in FIGS. 3, 4, 5 and 8. Here it will be noted that when it is desired to retract the segmented glass curtains, a motor (not shown) which drives the roller is actuated by closure of a suitable switch to cause the motor to drive the roller subassembly in the proper direction of rotation to roll the segmented glass curtain thereupon.

As has been previously pointed out, the opposed end edges of the several glass slats 48 constituting the lateral edges of the flexible segmented glass curtains 44 and 46 are guided by the tracks or channels formed by the vertically extending side track panel subassemblies 22, and the central vertically extending track panel subassembly 24. The same guiding-tracking action occurs during both extension of the segmented glass curtains to the closed position, and retraction of the curtains to the rolled up, cabinet-opening position.

Secured to the under side of the bottom panel 34 at two spaced locations therealong by means of suitable spaced roller brackets 76 are a pair of rollers 78. One of these rollers 78 and the bracket 76 by which it is mounted are illustrated in FIG. 3. These rollers 78 function to guide and support the segmented glass curtains 44 and 46 as they move up and down in the channels formed by the vertically extending side track panel subassemblies 22 and the central, vertically extending side track panel subassembly 24. It will also be noted in referring to FIG. 3 that the vertically extending track panel subassembly 22 there shown has its facing surfaces lined with felt strips 82 upon which the end portions of the glass slats 48, and the corner brackets 50 receiving these end portions, can slide. Similar felt strips line the facing surfaces of the other track panel subassembly 22, as well as the central vertically extending track panel subassembly 24. The corner brackets 50 function, in addition to retaining the respective glass slats 48 in the proper orientation, and protecting the end portions of these slats, to protect with the felt strips, the channels formed within the upwardly extending side track panel subassemblies 22 and the central vertically extending track panel subassembly 24 from scarring or gouging by the sharp corners of the glass panels.

It will be noted in referring to FIGS. 3 and 4, that the forward longitudinal edge of the bottom panel 34 which is adjacent the front of the cabinet is beveled, and that the felt strips 82 extend up over this beveled edge on the bottom panel. On the top side of the bottom panel 38 adjacent the beveled forward surface thereof are a pair of spaced guide rollers 86. Each guide roller 86 is supported by a suitable bracket 88 for rotation about a horizontal axis. The two guide rollers in each of the pairs of guide rollers are positioned and spaced so as to bear against the glass slats 48 at a location near each of the end edges thereof. These rollers 86 function to guide the segmented curtains 44 and 46 downwardly into the felt-lined trackways or channels which receive the opposite side edges thereof in the manner hereinbefore described.

As the two, horizontally spaced segmented curtains 44 and 46 are rolled upon the roller subassembly 56 at the two spaced locations therealong, the several glass slats supported in the end brackets 50 at the end of each slat are caused to roll up onto the felt-covered cylinder in the manner shown in FIG. 4. Here it will be noticed that several of the slats are imposed flatly in superimposed relationship over the elongated rectangular aluminum plates 60 contained in the rectangular brackets 63. It will also be noted that the stiffness of the stranded cables or wire 52 and 54 causes them to remain separated and aids in holding the glass slats in a position such that they will not break or crack as they are rolled up on the roller subassemblies. Further, those glass slats which are immediately adjacent the felt covering 59 on the metal cylinder 57 are cushioned by the felt at the place where they contact it as they are being wound up on the roller subassembly.

Although a preferred embodiment of the invention has been herein described in order to illustrate the operating principles upon which the invention is based, it will be understood that various changes and innovations can be made in the described and illustrated embodiment of the invention, so that it assumes other forms, doing so without departure from these basic principles. Changes and innovations of this type are therefore deemed to be circumscribed by the spirit and scope of the invention, except as the same may be necessarily limited by the appended claims or reasonable equivalents thereof.

What is claimed is:

1. A display enclosure comprising:

a rigid housing having an upper part and a lower part, and having a vertically extending opening on one side thereof extending predominantly in a single vertical plane;

track means at opposite sides of the opening in the housing:

roller means mounted on the upper part of said housing above the opening, and supported for rotation about a substantially horizontally extending axis extending substantially parallel to said plane; and a segmented curtain connected to said roller means for undergoing a rolling up or down movement upon rotation of said roller means about said axis in a selected direction of rotation, said segmented curtain comprising:

a plurality of contiguous, elongated generally rectangular slats each including a pair of opposed, parallel, longitudinal edges, and each including a pair of opposite ends extending slidingly into said track means;

bracket means each connected to one of the opposite ends of each of said slats so that each of said slats is connected through its opposite ends to a spaced pair of said bracket means; and a pair of spaced, elongated, flexible connecting elements each having an end part connected to said roller means, and each having a plurality of spaced connection points located along its length spaced from each other by a distance slightly greater than the width of said slats between said parallel, longitudinal edges and connected at each of said connection points to one of said bracket means, said connecting elements hanging said slats in a substantially monoplanar array across and closing said opening when said segmented curtain is rolled down by rotation of said roller means about said axis in a selected direction of rotation.

2. A display enclosure as defined in claim 1 wherein each of said slats is transparent glass.

3. A display enclosure as defined in claim 1 wherein each of said slats has right angular corners at its opposite ends, and wherein each of said bracket means is an L-shaped bracket which defines a right angle, and each of said brackets is of a C-shaped channel configuration and receives, and is retained on, a right angular corner of one of said slats.

4. A display enclosure as defined in claim 1 wherein said roller means comprises:

a rigid cylindrical roller;

felt covering the outer periphery of said cylindrical roller;

a rigid plate secured over the felt on the outer periphery of the cylindrical roller and having a length at least as long as each of said slats; and means supporting said roller for rotation about said axis.

5. A display enclosure as defined in claim 4 and further characterized as including a motor in the upper part of said rigid housing and drivingly connected to said roller.

6. A display enclosure as defined in claim 1 wherein each of said flexible connecting elements is a flexible cable.

7. A display enclosure as defined in claim 2 wherein each of said slats is about one and one-half inch in width and wherein the longitudinal edges of each pair of adjacent slats are separated by about 1/16 inch.

8. A display enclosure as defined in claim 3 wherein each of said slats is transparent glass.

9. A display enclosure as defined in claim 8 wherein each of said flexible connecting elements is a flexible cable, and has one end connected to said roller means, and has said spaced connection points each secured to one of the legs of one of said brackets.

* * * * *

UNITED STATES PATENT AND TRADEMARK OFFICE

CERTIFICATE OF CORRECTION

PATENT NO. : 5,065,805

DATED : November 19, 1991

INVENTOR(S) : David M. Barrett, et al

It is certified that error appears in the above-identified patent and that said Letters Patent is hereby corrected as shown below:

Title page, item [73], "Barett" should read --Barrett--.

Signed and Sealed this

Twenty-second Day of June, 1993

*Attest:*

Michael K. Kirk

MICHAEL K. KIRK

*Attesting Officer*

*Acting Commissioner of Patents and Trademarks*